US006945185B2

(12) United States Patent
Ribble et al.

(10) Patent No.: US 6,945,185 B2
(45) Date of Patent: Sep. 20, 2005

(54) APPARATUS, SEAMING ASSEMBLY AND METHOD FOR PLACING SEAMS IN A CONTINUOUSLY MOVING WEB

(75) Inventors: Brendon Frank Ribble, Menasha, WI (US); Robert Clarke Hochholzer, Kimberly, WI (US); Joseph Robert Riegert, Black Creek, WI (US)

(73) Assignee: Kimberly-Clark Worldwide, Inc., Neenah, WI (US)

( * ) Notice: Subject to any disclaimer, the term of this patent is extended or adjusted under 35 U.S.C. 154(b) by 302 days.

(21) Appl. No.: 10/348,395

(22) Filed: Jan. 21, 2003

(65) Prior Publication Data

US 2004/0139896 A1 Jul. 22, 2004

(51) Int. Cl.[7] ..... D05B 23/00; D05B 35/02

(52) U.S. Cl. ..... 112/475.06; 112/304; 112/470.13

(58) Field of Search ..... 112/470.12, 141, 112/153, 470.13, 129, 307, 305, 475.06–475.08, 304; 83/76, 156, 331, 353, 936, 956; 156/93

(56) References Cited

U.S. PATENT DOCUMENTS

| | | | | | |
|---|---|---|---|---|---|
| 3,371,630 A | * | 3/1968 | Cash, Jr. | ..... | 112/470.12 |
| 4,192,241 A | * | 3/1980 | Reed et al. | ..... | 112/117 |
| 4,589,361 A | * | 5/1986 | Starnes et al. | ..... | 112/470.05 |
| 5,022,336 A | * | 6/1991 | Iwase | ..... | 112/304 |
| 5,027,726 A | * | 7/1991 | Brower et al. | ..... | 112/117 |
| 5,096,532 A | | 3/1992 | Neuwirth et al. | ..... | 156/580.1 |
| 5,101,747 A | * | 4/1992 | Gerber | ..... | 112/470.13 |
| 5,110,403 A | | 5/1992 | Ehlert | ..... | 156/580.1 |
| 5,913,277 A | * | 6/1999 | Resta | ..... | 112/470.12 |
| 6,012,403 A | * | 1/2000 | Codos et al. | ..... | 112/117 |

FOREIGN PATENT DOCUMENTS

| | | | |
|---|---|---|---|
| BE | 699568 | 11/1967 | |
| EP | 0087395 A1 | 8/1983 | ..... D05B/11/00 |
| EP | 1013813 A1 | 6/2000 | ..... D05B/25/00 |
| WO | WO-0194674 A2 | 12/2001 | |

* cited by examiner

*Primary Examiner*—Ismael Izaguirre
(74) *Attorney, Agent, or Firm*—Schwegman Lundberg Woessner & Kluth P.A.

(57) ABSTRACT

A seaming assembly for placing seams in a continuously moving web of material. The seaming assembly includes a first support that is movable in a machine direction and a second support which is secured to the first support. The second support is movable relative to the first support in a cross direction. A seaming mechanism is mounted on the second support to place seams in the web that are at least partially in the cross direction. The first support may be movable in the machine direction at a speed that is substantially the same as the web such that the seaming mechanism places seams in the web that are substantially in the cross direction.

31 Claims, 3 Drawing Sheets

APPARATUS, SEAMING ASSEMBLY AND METHOD FOR PLACING SEAMS IN A CONTINUOUSLY MOVING WEB

BACKGROUND

Bath towels, beach towels, washcloths or the like are typically produced from fabric that is stored in roll form on a spool. The fabric is unrolled from the spool in a machine direction, cut into sections, and bonded in the machine direction and a cross direction to form at least partially finished products.

The web is sometimes formed using fabric from multiple spools, such that the web is made up of multiple layers of material that must be bonded together. As used herein, the term "layer" when used in a singular form may refer to a single layer element or multiple layer elements.

In some processes, the web is bonded in the machine direction (often manually) and then cut into sections, so that the cut edges of the sections can be manually bonded in the cross direction. In other processes, the web is cut into sections without any type of bonding, such that each section must be manually bonded in both the machine and cross directions.

As used herein, the term "machine direction" refers to along the length of a material, fabric, or web, in the direction in which it moves as it is produced. The terms "cross-machine direction" or "cross direction" refer to along the width of a material, fabric, or web (i.e., a direction generally perpendicular to the machine direction).

The labor associated with manually bonding the web or web sections adds unwanted production costs, especially bonding in the cross direction. Bonding in the cross direction is cumbersome, because the web must be cut into sections, and then each of the sections maneuvered to permit access to the cut edges for manual bonding in the cross direction.

The web and/or cut out web sections are typically bonded near the perimeter. In some processes, interior areas of the web or web sections are manually bonded for stability and/or decorative effect. The edges of the web are also often folded over and manually bonded to form hems along the web edges. Forming hems along the cut edges of web sections is even more problematic because of the work required to manipulate the cut web sections for folding and then bonding.

There is a need for an apparatus, seaming assembly and method that effectively places seams in a continuously moving web of fabric in a cross direction, or in both machine and cross directions. The apparatus, seaming assembly and method should make it less expensive to produce bath towels, beach towels, washcloths or the like by efficiently bonding portions of a web that is formed from at least one spool of fabric.

SUMMARY OF THE INVENTION

The present invention relates to a seaming assembly for placing seams on a continuously moving web of material. The seaming assembly includes a first support that is movable in a first direction, and a second support that is secured to the first support. The second support is movable relative to the first support in a second direction. A seaming mechanism is mounted on the second support to place seams in the web that are at least partially in the second direction.

The first direction may be a machine direction while the second direction may be a cross direction such that the first support moves in the machine direction and the second support moves relative to the first support in the cross direction. In addition, the first support may be movable in the machine direction at a speed that is substantially the same as the web such that the seaming mechanism on the second support places seams in the web that are substantially in the cross direction.

In another aspect, the present invention relates to an apparatus for placing seams in a continuously moving web of material. The apparatus includes a first seaming assembly and a second seaming assembly. The first seaming assembly includes a first seaming mechanism that places seams along the web in a first direction. The second seaming assembly includes a first support that moves in the first direction and a second support that is secured the first support. The second support moves relative to the first support in a second direction, such that a second seaming mechanism, which is mounted on the second support, places seams in the web that are at least partially in the second direction. The first direction may similarly be a machine direction, while the second direction may similarly be a cross direction such that the first support moves in the machine direction and the second support moves relative to the first support in the cross direction.

In still another aspect, the present invention relates to a method of placing seams in a moving web. The method includes feeding the web into a first seaming assembly and moving a first support in the first seaming assembly in a first direction. The method further includes (i) moving a second support that is secured to the first support relative to the first support in a second direction; and (ii) placing seams in the web that are at least partially in the second direction using a seaming mechanism that is mounted on the second support.

Moving the first support may include moving the first support in a machine direction, and moving the second support relative to the first support may include moving the second support in a cross direction. In addition, moving the first support may include moving the first support at a speed that is substantially the same as the web such that placing seams in the web includes placing seams in the web in the cross direction.

In yet another aspect, the present invention relates to a method of placing seams in a moving web. The method includes feeding the web into a first seaming assembly and placing seams in the web that are in a first direction using a first seaming mechanism on the first seaming assembly. The method further includes feeding the web into a second seaming assembly; moving a first support of the second seaming assembly in the first direction; moving a second support that is secured to the first support relative to the first support in a second direction; and placing seams in the web that are at least partially in the second direction using a second seaming mechanism that is mounted on the second support of the second seaming assembly.

The method may further include operating the first seaming assembly independently from the second seaming assembly. In addition, the second seaming assembly may place seams in the web before the first seaming assembly.

The purposes and features of the present invention will be set forth in the description that follows. Additional features of the invention will be realized and attained by the product and processes particularly pointed out in the written description and claims hereof, as well as from the appended drawings.

It is to be understood that both the foregoing general description and the following detailed description are exemplary and are intended to provide further explanation of the invention claimed. The accompanying drawings, which are incorporated in and constitute part of this specification, are included to illustrate and provide a further understanding of the invention.

BRIEF DESCRIPTION OF THE DRAWINGS

The present invention will be more fully understood, and further features will become apparent, when reference is made to the following detailed description and the accompanying drawings. The drawings are merely representative and are not intended to limit the scope of the claims. Like parts depicted in the drawings are referred to by the same reference numerals.

DETAILED DESCRIPTION OF THE INVENTION

In the following detailed description, reference is made to the accompanying drawings, which show specific embodiments in which the invention may be practiced. These embodiments are described in sufficient detail to enable those skilled in the art to practice the invention. It is to be understood that other embodiments may be utilized and structural changes made, such that the following detailed description is not to be taken in a limiting sense.

Figure 1:
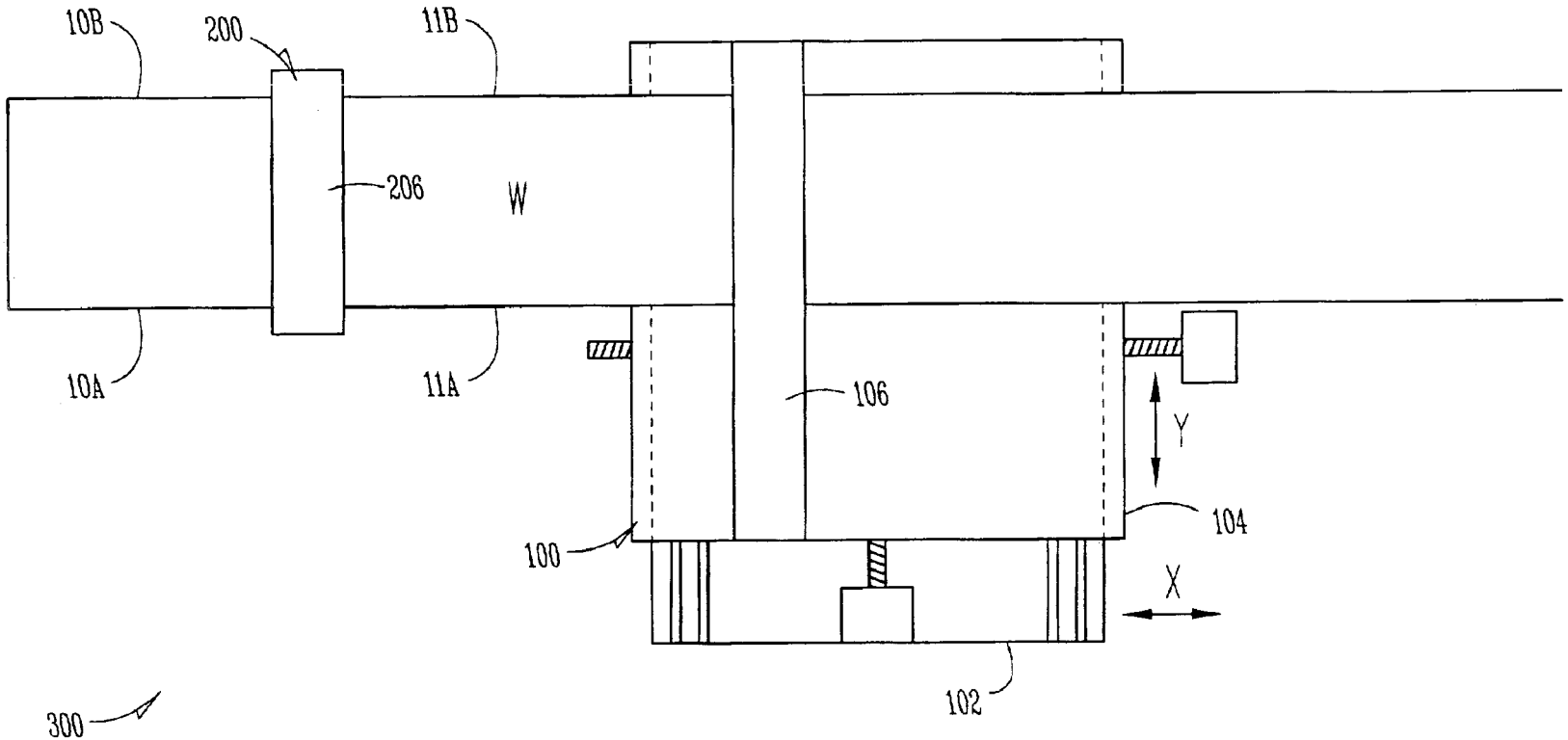
FIG. 1 illustrates a schematic top plan view of a seaming assembly and an apparatus for placing seams in a continuously moving web of material.
Figure 2:
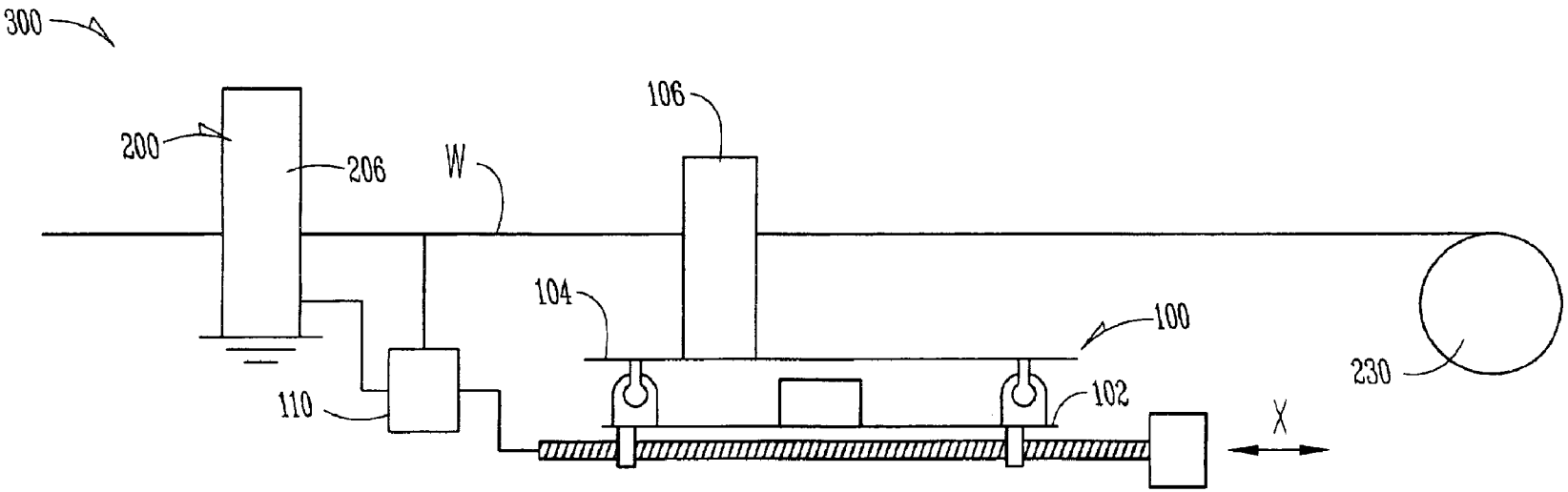
FIG. 2 illustrates a schematic side plan view of the seaming assembly and apparatus shown in FIG. 1.

FIGS. 1 and 2 illustrate a seaming assembly 100 for placing seams in a continuously moving web W of material. The seaming assembly 100 includes a first support 102 that is movable back and forth in a first direction and a second support 104 that is secured to the first support 102. Supports 102, 104 can be any type of supporting structure including, but not limited to, combinations of platforms, bars, members, levers and arms.

The second support 104 is movable back and forth relative to the first support 102 in a second direction. A seaming mechanism 106 is mounted on the second support 104 to place seams in the web W that are at least partially in the second direction.

As shown in FIGS. 1–2, the first direction may be a machine direction while the second direction may be a cross direction such that the first support 102 cycles back and forth in the machine direction (denoted by arrow X), and the second support 104 cycles back and forth relative to the first support 102 in the cross direction (denoted by arrow Y). In addition, the first support 102 may be movable in the machine direction for part of the movement cycle at a speed that is substantially the same as the speed of the web W. When the speed of the web W matches the speed of the first support 102, the seaming mechanism 106, which is mounted to the first support 102 via the second support 104, is able to place seams in the web W that are substantially in the cross direction. If the speed of the web W is different from the speed of the first support 102, the seaming mechanism 106 places seams diagonally across the web W. Seaming mechanism 106 may include any device that places seams in the web W, including, but not limited to, sewing assemblies, ultrasonic bonding assemblies, heat sealing assemblies and/or adhesive bonding assemblies, or any combinations thereof.

Some types of adhesive bonding assemblies include meltblown, control-coat, swirl and slot and line. One example adhesive assembly is a J&M type DURAMELT™ melt tank model # B11159 with a DURAFIBER II™ applicator for desired width using DURAFIBER II™ Die assemblies and DURAFIBER II™ SpinPacks, which can be used in meltblown, swirl or line and slot coat adhesive applications. An example control coat adhesive assembly is an ITW DYNATEC DYNAMELT® Adhesive Supply Unit Model S10 with DYNAFIBER™ UFD Adhesive applicators.

It should be noted that the seaming mechanism may include any number and type of sewing assemblies that perform one or more types of stitching, including lockstitching and chain-stitching. The stitching may be done in accordance with Federal Standard 751 a for Stitches, Seams and Stitching.

One example type of sewing assembly for performing single needle lockstitch is a Pfaff 483-G-8/01-900/99BS. In addition, an example type of sewing assembly for performing dual needle lockstitch is a Pegasus TM625 with 2 needle capability. A Pfaff 5483-814/01-6/01-900/71BS may be used to perform single needle chainstitching and a Pfaff 5483-H-814/01-6/01-900/71-910/04-911/35 BS may be used to perform chainstitching with backtack.

In addition, seaming mechanism 106 may include any number and type of ultrasonic bonding assemblies, such as rotary ultrasonic bonding assemblies. Some example rotary ultrasonic bonding assemblies are shown and described in U.S. Pat. Nos. 5,096,532 and 5,110,403, which are incorporated herein by reference.

The type of seam used to bond the web W will depend on such factors as (i) the type of material that forms the web; (ii) the type of finished product; (iii) the speed of the web; and (iv) the type of bonding assembly.

In some forms, the seaming assembly 100 includes a controller 110 (see FIG. 2) that monitors the speed of the web W and/or the first support 102. The controller 110 may adjust the speed of the web W and/or the first support 102 to properly align seams in the web W relative to the cross direction. Any controller known now, or developed in the future, may be used to monitor and adjust the speed of the web W and/or the first support 102. The controller 110 may include a system of sensors that are mounted along the web W and/or on the seaming assembly 100 to monitor the speed of the web W relative to the first support 102. One example controller is 1394 Sercos multi axis motion control hardware with CONTROLOGIX™ processor and RSLOGIX™ 5000 software manufactured by Rockwell Automation.

In some forms, seaming assembly 100 is part of an apparatus 300 for placing seams in a continuously moving web W of material. The apparatus 300 includes an additional seaming assembly 200. The seaming assembly 200 includes a seaming mechanism 206 that places seams along the web W in a first direction (e.g., the machine direction), while the seaming assembly 100 discussed above places seams in the web that are at least partially in a second direction (e.g., the cross direction).

The seaming assembly 200 may include a folder (not shown) that folds the side edges 10A, 10B (see FIG. 1) of the web W. In some forms, the seaming mechanism 206 places seams in the folded-over side edges to hem the edges of the web W. The web W with hemmed edges 11A, 11B (hems not visible) may subsequently be fed through the seaming assembly 100 so that seams can be placed in the web W in the cross direction.

It should be noted that folders may be custom made for right and left hem folding. Example folders are available from New York Sewing Machine Corp. The particular type of folder will depend on the application and will be determined based on hem dimensions, type of fold and the material to be folded.

In addition, the seaming assembly 100 may include a cutting assembly (not shown) that cuts the web W into sections. In one form, the cutting assembly is secured to the second support 104, such that the cutting assembly is movable relative to the first support 102 in the cross direction. The cutting assembly may cut the web W before or after the seaming mechanism 106 places seams in the web W. If the web W is cut before seams are added by the seaming mechanism 106, the seaming assembly 100 may also include a folder that folds the cut edges of the web sections, so that seams can be placed along the folded cut edges to hem the folded cut edges in the cross direction. One example cutter is an Eastman Chickadee Model D2 Cutter.

The seaming assembly 100 may operate independently from the seaming assembly 200, or work in conjunction with the seaming assembly 200. In addition, seaming assembly 100 may also be positioned before seaming assembly 200 such that the seaming mechanism 106 in seaming assembly 100 places seams in the web W before the seaming mechanism 206 in seaming assembly 200. In the sample form illustrated in FIG. 2, the apparatus 300 includes a winding assembly 230 that winds the web W onto a spool after seams are placed along the web W by at least one of the seaming assemblies 100, 200.

Figure 3:
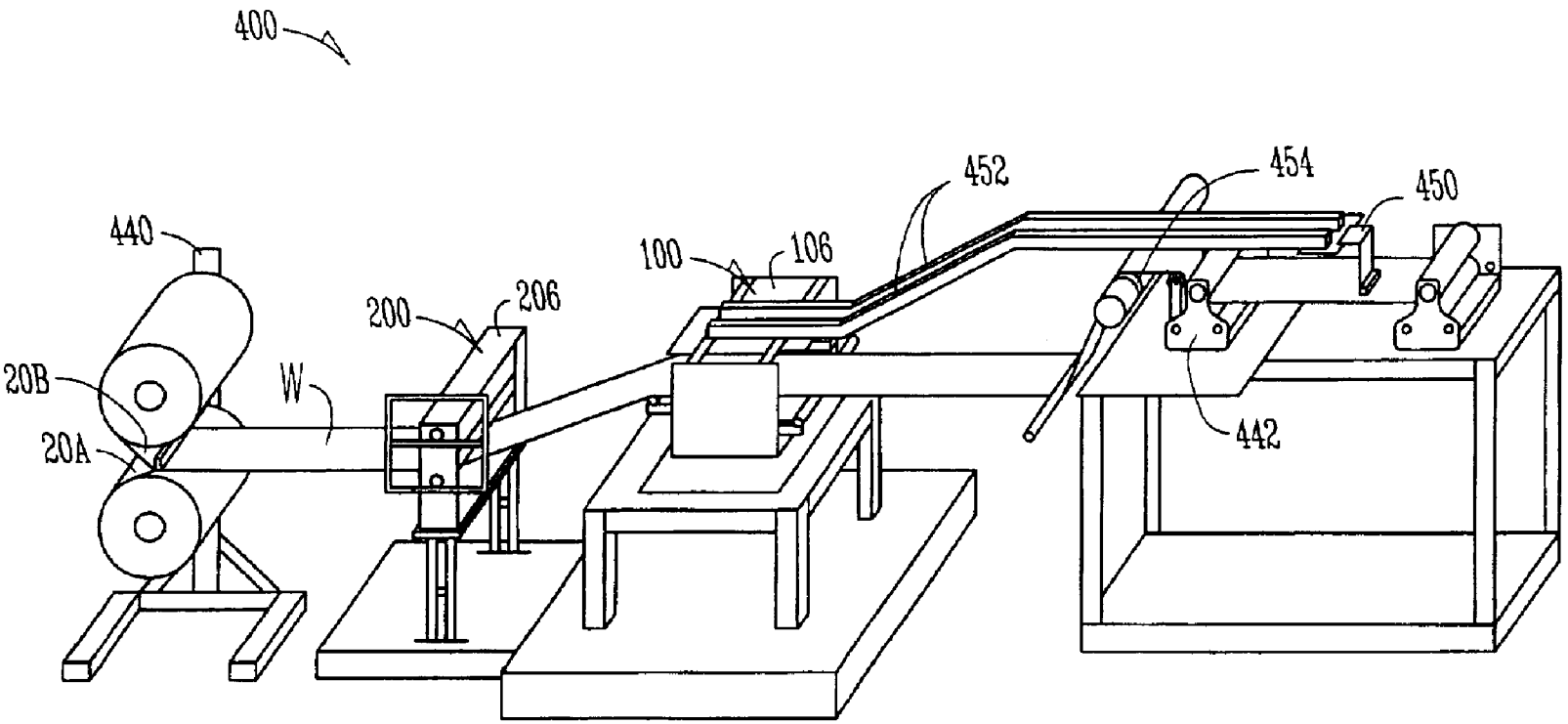
FIG. 3 shows a perspective view of another apparatus for placing seams in a continuously moving web of material.

Referring now to FIG. 3, there is depicted an apparatus 400 for placing seams in a continuously moving web W of material. The apparatus 400 includes seaming assemblies 100, 200 and a drive assembly 442. The drive assembly 442 may include nip rollers that pull the web W from an unwinding assembly 440. In some forms, the unwinding assembly 440 forms at least two layers of material 20A, 20B into the web W before the web W is fed through the seaming assemblies 100, 200. It should be noted that unwinding assembly 440 may form the web W from any number of layers.

Apparatus 400 may also include a cutting assembly 450 that cuts the web W into sections after at least one of the seaming assemblies 100, 200 places seams in the web. Cutting assembly 450 may be a stand-alone device, or secured directly or indirectly to the second support of seaming assembly 100, such as through members 452 (see, e.g., FIG. 3). When the cutting assembly 450 moves along with the second support of the seaming assembly 100 in the cross direction, the cutting assembly 450 is able cut the web W in the cross direction during that portion of the first support's movement cycle where the speed of the first support matches the speed of the web W.

Any number of cutting assemblies may be incorporated into any of the apparatuses, seaming assemblies and methods described herein. The type of cutting assembly will depend on such factors as (i) the type of material that forms the web; (ii) the type of finished product; and (iii) the speed of the web (among others).

In addition, the web may be cut in the machine direction depending on the arrangement of the seaming assemblies, cutting assemblies and/or folders, as well the desired size of the finished product. As an example, FIG. 3 shows a rotary slitting assembly 454 that cuts the longitudinal edges of the web W in the machine direction before the web is cut in the cross direction by cutting assembly 450.

A method of placing seams in a moving web W is described herein with reference to FIGS. 1–3. In one form, the method includes feeding the web W into a seaming assembly 100 and moving a first support 102 in the seaming assembly 100 in a first direction. The method further includes (i) moving a second support 104 that is secured to the first support 102 relative to the first support 102 in a second direction; and (ii) placing seams in the web W that are at least partially in the second direction using a seaming mechanism 106 that is mounted on the second support 104. Placing seams in the web W includes, but is not limited to, sewing stitches in the web W, placing ultrasonic bonds in the web W, and placing adhesive bonds in the web, or combinations thereof.

Moving the first support 102 may include moving the first support 102 in a machine direction, and moving the second support 104 relative to the first support 102 may include moving the second support 104 in a cross direction. The first support 102 may be moved in the machine direction at a speed that is substantially the same as the web W such that the seams are placed in the web W by the seaming mechanism 106 in substantially a cross direction.

The method may further include cutting the web W into sections such that the sections include cut edges. Cutting the web W into sections may be done before or after (see FIG. 3) the seaming assembly 100 places seams on the web W. If the web W is cut before the seaming assembly 100, the method may further include folding the cut edges of the web sections and seaming a hem along the folded over cut edges of each web section in the cross direction.

In some sample forms, the method includes monitoring and adjusting the speed of the web W and/or the first support 102 in the seaming assembly 100. As an example, a controller 110 may be used to continuously match the speed of the first support 102 to the speed of the web W during part of the first support's 102 movement cycle such that seaming mechanism 106 can place seams in the web W in substantially the cross direction.

The method may include forming the web W from at least two layers 20A, 20B of material before feeding the web W into the seaming assembly 100. It should be noted that any number of layers may be used in forming the web W. As shown in FIG. 2, the method may further include winding the web W onto a spool, such as by using winding assembly 230.

In another form, a method of placing seams in a moving web also includes feeding the web W into another seaming assembly 200 and placing seams in the web W that are in a first (e.g., machine) direction using a seaming mechanism 206 on the seaming assembly 200. The method may further include operating the seaming assembly 100 independently from the seaming assembly 200, or operating both devices in conjunction with one another through a controller, such as controller 100.

It should be noted that web W may be fed through any number of advancing rollers, such as idler rollers and dancer rollers, to maintain tension in the web. In addition, other techniques and structures known to those of skill in the art for advancing, cutting and/or folding a web could also be used in combination with the teachings herein. The particular technique and structure used is not critical as long as the employed technique and structure can place seams in the web of material as taught herein.

While the invention has been described in detail with respect to the specific aspects thereof, it will be appreciated that those skilled in the art, upon attaining an understanding of the foregoing, may readily conceive of alterations to, variations of, and equivalents to these aspects which fall within the spirit and scope of the present invention, which should be assessed accordingly to that of the appended claims.

We claim:

1. A seaming assembly for placing seams in a continuously moving web of material, the seaming assembly comprising:

a first support movable in a machine direction;

a second support secured to said first support, said second support being movable relative to said first support in a cross direction; and a seaming mechanism mounted on said second support to place seams in the web that are at least partially in said cross direction;

a cutting assembly that cuts the web into web sections which include cut edges, wherein said cutting assembly cuts the web before said seaming mechanism places seams in the web; and a folder that folds the cut edges of the web sections in said cross direction.

2. The seaming assembly of claim 1 wherein said seaming mechanism is capable of seaming a hem along the folded over cut edges of each web section in said cross direction.

3. A seaming assembly for placing seams in a continuously moving web of material, the seaming assembly comprising:

a first support movable in a machine direction;

a second support secured to said first support, said second support being movable relative to said first support in a cross direction; and a seaming mechanism mounted on said second support to place seams in the web that are at least partially in said cross direction;

a cutting assembly that cuts the web into web sections which include cut edges, wherein said cutting assembly cuts the web after said seaming mechanism places seams in the web.

4. A seaming assembly for placing seams in a continuously moving web of material, the seaming assembly comprising:

a first support movable in a machine direction;

a second support secured to said first support, said second support being movable relative to said first support in a cross direction; and a seaming mechanism mounted on said second support to place seams in the web that are at least partially in said cross direction, wherein said seaming mechanism includes an ultrasonic bonding assembly that places ultrasonic bonds in the web.

5. A seaming assembly for placing seams in a continuously moving web of material, the seaming assembly comprising:

a first support movable in a machine direction;

a second support secured to said first support, said second support being movable relative to said first support in a cross direction; and a seaming mechanism mounted on said second support to place seams in the web that are at least partially in said cross direction, wherein said seaming mechanism includes an adhesive bonding assembly that places adhesive bonds in the web.

6. A seaming assembly for placing seams in a continuously moving web of material, the seaming assembly comprising:

a first support movable in a machine direction;

a second support secured to said first support, said second support being movable relative to said first support in a cross direction;

a seaming mechanism mounted on said second support to place seams in the web that are at least partially in said cross direction; and a controller that monitors speed of at least one of the web and said first support, wherein said controller adjusts the speed of at least one of the web and said first support.

7. An apparatus for placing seams in a continuously moving web of material, the apparatus comprising:

a first seaming assembly that includes a first seaming mechanism to place seams in the web that are in a first direction; and a second seaming assembly that includes a first support movable in said first direction, a second support secured to said first support, such that said second support is movable relative to said first support in a second direction, and a second seaming mechanism mounted on said second support to place seams in the web that are at least partially in said second direction.

8. The apparatus of claim 7 wherein said first direction is a machine direction and said second direction is a cross direction.

9. The apparatus of claim 8 wherein said first support is movable in said machine direction at a speed that is substantially the same as the web such that said second seaming mechanism places seams in the web that are substantially in said cross direction.

10. The apparatus claim 8 further comprising a cutting assembly that cuts the web into sections.

11. The apparatus of claim 10 wherein said cutting assembly cuts the web after said second seaming mechanism places seams in the web.

12. The apparatus of claim 8 further comprising a controller that monitors and adjusts speed of at least one of the web and said first support in said second seaming assembly.

13. The apparatus of claim 8 further comprising a winding assembly that winds the web onto a spool after seams are placed in the web.

14. The apparatus of claim 8 wherein said first seaming mechanism and said second seaming mechanism each include a stitching assembly that sews stitches into the web.

15. The apparatus of claim 8 further comprising a folder that folds side edges of the web such that said first seaming assembly stitches a hem along at least one side edge of the web.

16. The apparatus of claim 7 wherein said first seaming assembly operates independently from said second seaming assembly.

17. The apparatus of claim 7 wherein said first seaming mechanism in said first seaming assembly places seams in the web before said second seaming mechanism in said second seaming assembly.

18. An apparatus for placing seams in a continuously moving web of material, the apparatus comprising:

a first seaming assembly that includes a first seaming mechanism with a stitching assembly that sews stitches in the web which are in a machine direction; and a second seaming assembly that includes a first support movable in said machine direction, a second support secured to said first support such that said second support is movable relative to said first support in a cross direction, and a second seaming mechanism mounted on said second support, the second seaming mechanism including a second stitching assembly that sews stitches in the web which are at least partially in said cross direction;

a cutting assembly that cuts the web into sections;

a controller that monitors and adjusts speed of at least one of the web and said first support in said second seaming assembly; and a feeding assembly that moves the web through the apparatus.

19. The apparatus of claim 18 wherein said first support in said second seaming assembly is movable in said machine direction at a speed that is substantially the same as a speed of the web such that said second stitching assembly sews stitches in the web which are substantially in said cross direction.

20. The apparatus of claim 18 wherein said first seaming assembly sews stitches in the web before said second seaming assembly.

21. A method of placing seams in a moving web, the method comprising:

feeding the web into a seaming assembly;

moving a first support in the seaming assembly in a machine direction;

moving a second support that is secured to the first support relative to the first support in a cross direction;

placing seams in the web that are at least partially in said cross direction using a seaming mechanism that is mounted on the second support of the seaming assembly;

cutting the web into web sections that include cut edges; and folding the cut edges of the web sections.

22. The method of claim 21 further comprising seaming a hem into the folded cut edges of each web section in the cross direction.

23. A method of placing seams in a moving web, the method comprising:

feeding the web into a seaming assembly;

moving a first support in the seaming assembly in a machine direction;

moving a second support that is secured to the first support relative to the first support in a cross direction;

placing seams in the web that are at least partially in said cross direction using a seaming mechanism that is mounted on the second support of the seaming assembly; and cutting the web into web sections that include cut edges, wherein cutting the web into sections includes cutting the web after the seaming mechanism places seams in the web.

24. A method of placing seams in a moving web, the method comprising:

feeding the web into a seaming assembly;

moving a first support in the seaming assembly in a first direction;

moving a second support that is secured to the first support relative to the first support in a second direction; and placing seams in the web that are at least partially in said second direction using a seaming mechanism that is mounted on the second support of the seaming assembly, wherein placing seams in the web includes placing ultrasonic bonds in the web.

25. A method of placing seams in a moving web, the method comprising:

feeding the web into a seaming assembly;

moving a first support in the seaming assembly in a first direction;

moving a second support that is secured to the first support relative to the first support in a second direction; and placing seams in the web that are at least partially in said second direction using a seaming mechanism that is mounted on the second support of the seaming assembly, wherein placing seams in the web includes placing adhesive bonds in the web.

26. A method of placing seams in a moving web, the method comprising:

feeding the web into a first seaming assembly;

placing seams in the web that are in a first direction using a first seaming mechanism on the first seaming assembly;

feeding the web into a second seaming assembly;

moving a first support of the second seaming assembly in the first direction;

moving a second support that is secured to the first support relative to the first support in a second direction; and placing seams in the web that are at least partially in said second direction using a second seaming mechanism that is mounted on the second support of the second seaming assembly.

27. The method of claim 26 further comprising operating the first seaming assembly independently from the second seaming assembly.

28. The method of claim 26 wherein moving the, first support includes moving the first support in a machine direction, and moving the second support relative to the first support includes moving the second support in a cross direction.

29. The method of claim 28 wherein moving the first support in a machine direction includes moving the first support at a speed that is substantially the same as the web such that placing seams in the web includes placing seams in the web in substantially a cross direction.

30. A method of placing seams in a moving web, the method comprising:

feeding the web into a first seaming assembly;

sewing stitches in the web that are in a machine direction using a first seaming mechanism on the first seaming assembly;

feeding the web into a second seaming assembly;

moving a first support in the second seaming assembly in the machine direction at a speed that is substantially the same as the web;

moving a second support that is secured to the first support relative to the first support in a cross direction; and sewing stitches in the web that are in substantially the cross direction using a second seaming mechanism that is mounted on the second support of the second seaming assembly.

31. The method of claim 30 further comprising monitoring and adjusting speed of at least one of the web and the first support in the second seaming assembly.

* * * * *